US007309926B2

(12) United States Patent
Watt

(10) Patent No.: US 7,309,926 B2
(45) Date of Patent: Dec. 18, 2007

(54) SOLAR-POWERED PUMPING DEVICE

(75) Inventor: Stephen Bruce Watt, Surrey Hills (AU)

(73) Assignee: Mono Pumps Limited, Manchester (GB)

( * ) Notice: Subject to any disclaimer, the term of this patent is extended or adjusted under 35 U.S.C. 154(b) by 676 days.

(21) Appl. No.: 10/768,833

(22) Filed: Jan. 29, 2004

(65) Prior Publication Data

US 2004/0219039 A1 Nov. 4, 2004

(30) Foreign Application Priority Data

Jan. 31, 2003 (AU) ..... 2003200316

(51) Int. Cl.
*F02B 63/04* (2006.01)
*F03G 7/08* (2006.01)
*H02K 7/18* (2006.01)

(52) U.S. Cl. ..... 290/1 R

(58) Field of Classification Search ..... 290/1 R; 323/906; 320/101; 60/659, 641.11, 641.12
See application file for complete search history.

(56) References Cited

U.S. PATENT DOCUMENTS 3,965,683 A * 6/1976 Dix ..... 60/641.15
4,249,083 A * 2/1981 Bitterly ..... 290/1 R
4,280,328 A * 7/1981 Falconer ..... 60/641.12
4,476,853 A * 10/1984 Arbogast ..... 126/578
4,489,243 A * 12/1984 Nola ..... 307/64
4,718,233 A * 1/1988 Barrett ..... 60/496
4,916,382 A * 4/1990 Kent ..... 323/299
5,553,661 A * 9/1996 Beyerlein et al. ..... 165/203
5,929,530 A * 7/1999 Stone ..... 290/2
6,051,891 A * 4/2000 Surodin ..... 290/2
6,080,927 A * 6/2000 Johnson ..... 136/248
6,315,523 B1 * 11/2001 Mills ..... 417/45
6,485,152 B2 * 11/2002 Wood ..... 359/853
7,164,383 B2 * 1/2007 Fagan et al. ..... 342/357.02
2001/0051521 A1 * 12/2001 Castiel et al. ..... 455/429
2004/0245782 A1 * 12/2004 Loschmann ..... 290/1 R

OTHER PUBLICATIONS

EPS-TENERIFE, "When phototropism turns sapiens", Dec. 12, 2002, 3 pages.
"EPS-TENERIFE: When phototropism turns *sapiens*." Internet article, InSpira Sun Center Engineering, http://www.inspira.es/newsroom/981130.html, Nov. 30, 1998.

* cited by examiner

*Primary Examiner*—Julio Gonzalez
(74) *Attorney, Agent, or Firm*—Blakely, Sokoloff, Taylor & Zafman; Stephen M. De Klerk

(57) ABSTRACT

A solar-powered pumping device comprising:
a solar power converter for generating power from sunlight;
a pump driven by power from said solar power converter;
an actuator for controlling the orientation of said solar power converter; and
a controller for controlling said actuator to orient said solar power converter for optimum generation of power, said controller comprising a receiver for receiving broadcast time data, and an ephemerides calculator for calculating the position of the sun on the basis of the received time data.

8 Claims, 1 Drawing Sheet

SOLAR-POWERED PUMPING DEVICE

FIELD OF THE INVENTION

The present invention relates to solar-powered pumping devices, for example devices that can be used for bore water pumping and surface transfer in remote locations.

BACKGROUND

A particular problem of water pumping in remote areas is the provision of power to the pump. The provision of mains electricity is often expensive and only economic if only a short extension of the power lines is required or for particularly large installations. Diesel generators provide a predictable output but require regular maintenance and refuelling. Windmills generally provide good service in suitable locations but their output is affected by wind droughts and they require regular maintenance. Solar-powered pumps are therefore advantageous and are particularly cost-effective when there is a lower power requirement, the site is remote and has no reliable electricity supply.

An important factor in maximising the efficiency of a solar-powered pumping array is to maximise the conversion of sunlight to electricity. Motors with an efficiency of 90% or more and pumps with an efficiency of 70% or more are available but solar cell arrays often have an efficiency of less than 15%. The efficiency of a solar cell array can be maximised by accurately pointing the array at the sun. Known electronic tracking systems utilise light sensitive sensors that measure incoming solar radiation or light. Two opposing sensors ate placed on the solar array at opposing angles to the array's perpendicular. The array frame is then driven via a motor to balance the signal between the two sensors. This system does not have a great reliability record as the sensors must be mounted in direct sunlight, which can lead to degradation over time. The sensors must be connected to an electronic controller via an electrical wiring loom, which is routed around the array frame. External sensors have a history of being broken off accidentally, either in transport or in day to day use. These systems can also incorporate electrical stops and sensors to detect motor positions and end stops, which also have long term reliability problems as they are continuously exposed to the weather.

Another type of system utilises gas-filled tanks or a gas-filled frame as a method of positioning the solar array. As the solar radiation heats up the array, the gas transfers from one side of the array to the other, moving the array frame until the system is in a balanced state directed towards the sun. Such gas trackers have been found to have reliability issues with gas leaks and system imbalances causing erratic operation. This system is also very difficult to manufacture and transport as the system is very bulky and heavy.

Both of the above-described systems do not perform adequately in cloudy or low light conditions, as the amount of solar radiation is limited on these occasions.

To counteract low light problems, electronic solar trackers can use a time clock to keep track of the sun position but then an accurate time base is required, otherwise a cumulative time error can produce a large error over years of operation. It is also necessary to initially set the time and adjust the system for the location of the device, which can introduce errors.

SUMMARY

It is therefore an aim of the present invention to provide an improved solar-powered pumping device.

According to the present invention, there is provided a solar-powered pumping device comprising:

a solar power converter for generating power from sunlight;

a pump driven by power from said solar power converter;

an actuator for controlling the orientation of said solar power converter; and a controller for controlling said actuator to orient said solar power converter for optimum generation of power, said controller comprising a receiver for receiving broadcast time data, and an ephemerides calculator for calculating the position of the sun on the basis of the received time data.

By basing the calculation of the position of the sun and thence the control of the orientation of the solar power converter on broadcast time information, the need for an accurate internal clock in the device is avoided and set-up of the device on installation is simplified. The broadcast time information is preferably based on a satellite-based positioning system, such as GPS, which ensures that the time signal can be received wherever in the world the device may be located. In addition, position information can be derived from the GPS signals and used as the basis of the ephemerides calculation so that set-up of the device is fully automatic.

The pump is preferably a progressing cavity pump. Such pumps have a relatively constant efficiency with variation in head and speed so that the device remains efficient under varying sunlight conditions and with varying load.

The invention is particularly advantageous when applied to devices using a solar cell array as the solar power converting device as such arrays are relatively sensitive to sub-optimum orientation.

BRIEF DESCRIPTION OF THE DRAWINGS

The present invention will be further described below with reference to exemplary embodiments and the accompanying drawings, in which.

In the various figures, like parts are denoted by like reference numerals.

DESCRIPTION OF PREFERRED EMBODIMENTS

Figure 1:
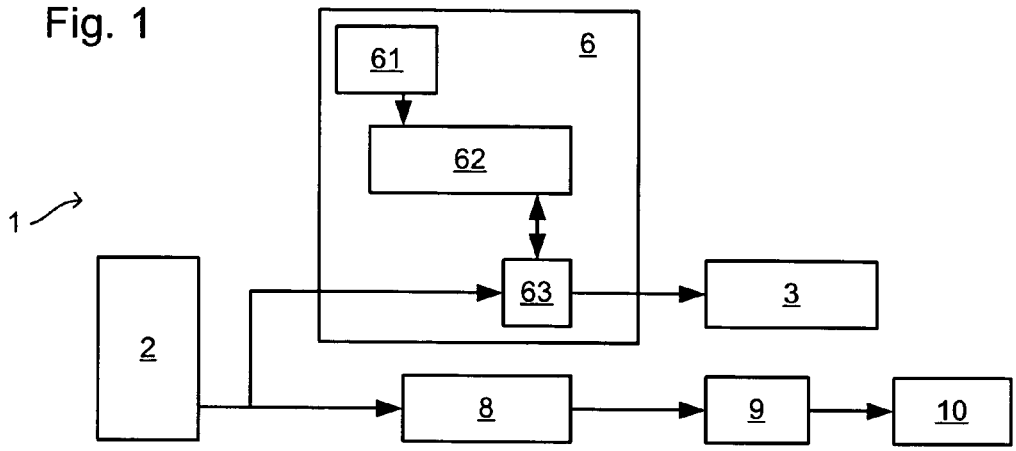
FIG. 1 is schematic of a solar powered pumping device according to the present invention.
Figure 2:
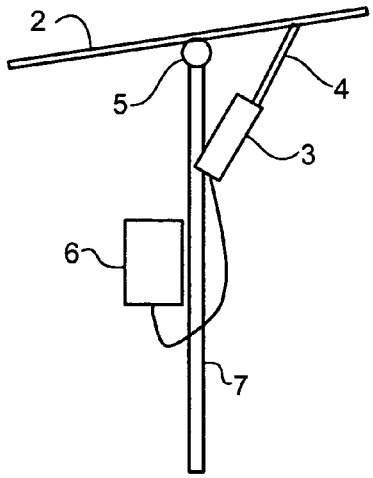
FIG. 2 is a side view of the solar cell array and control arrangement of the pumping device according to the resent invention.

A pumping device 1 according to a first embodiment of the invention is shown in FIGS. 1 and 2. Solar cell array or panel 2 converts sunlight to electricity which powers electric motor 9 to drive pump 10 and also powers controller 6. To provide maximum output from the solar cell array it must follow the sun and to this end is mounted on support 7 via pivot 5. Actuator 3, which is mounted on the support 7 and connected to the solar cell array 2 by link 4, rotates the solar cell array 2 about pivot 5 under the control of controller 6.

Controller 6 includes a GPS receiver 61 which, when activated, provides a data stream including the time (Greenwich Mean Time) and position data, including latitude, longitude and elevation. A microprocessor 62 receives the data stream and extracts the desired information, principally time and longitude data, necessary to calculate the current relative position (ephemeris) of the sun. From this, an appropriate orientation of the solar cell array 2 for maximum output can be determined and actuator 3 is driven via motor drive 63 to position the solar cell array appropriately.

Actuator 3 may comprise a reversible DC motor whose rotational movement is converted to a linear movement by link 4 and/or gearing. An appropriate sensor, e.g a reed switch, Hall effect sensor, encoder, or current measurement device is provided to determine the position of the motor, and hence of the solar cell array, so that the solar cell array 2 can be stopped in the correct position via a feedback loop.

Motor 9 is in this embodiment a brushless submersible DC motor having a high efficiency due to the use of rare-earth rotor magnets, low loss stator coils and back-emf electronic commutating. It is driven via drive circuit 8, a maximum power point tracker (MPPT) which provides a relatively constant current output with voltage and hence motor speed varying with sunlight levels. This maximises efficiency of the device. The pump is a positive displacement pump, such as a progressing cavity pump.

Figure 3:
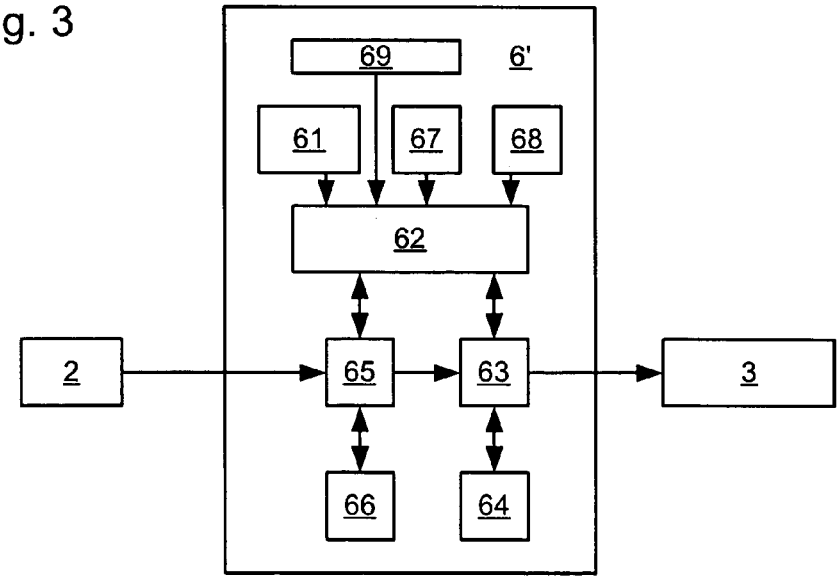
FIG. 3 is a schematic of an alternative control arrangement useable in a pumping device according to the present invention.

An alternative controller 6', having some additional optional features is shown in FIG. 3.

Controller 6' includes a battery 66, with power supply and charger 65 to charge the battery, to allow the controller to function correctly even when light levels are low and to provide power to park the solar cell array in a horizontal position overnight and drive it to an easterly facing position in the morning. A motor position feedback circuit 64 electronically detects the current spikes when the motor brushes pass the commutator and hence can provide a motor position signal, obviating the need for an external position sensor.

Display 69, keypad 67 and communication port 68 are connected to the microcontroller 62 to allow additional functions such as manual override, diagnostics and downloading operational data.

Whilst a specific embodiment of the invention has been described, it will be appreciated that variations may be made. The present invention is defined by the appended claims, rather than the foregoing description.

The invention claimed is:

1. A solar powered pumping device comprising:

a solar power converter for generating power from sunlight;

a pump driven by power from said solar power converter;

an actuator for controlling the orientation of said solar power converter; and a controller for controlling said actuator to orient said solar power converter for optimum generation of power, said controller comprising a receiver for receiving broadcast time data, and an ephemerides calculator for calculating the position of the sun on the basis of the received time data, said actuator being controlled based in said position of the sun calculated based on said broadcast time data.

2. A pumping device according to claim 1 wherein said receiver is adapted to derive said broadcast time data from signals broadcast by a satellite-based positioning system.

3. A pumping device according to claim 2 wherein said receiver is further adapted to derive position information from said signals broadcast by said satellite-based positioning system and said actuator is controlled based on said position of the sun calculated based on said position information.

4. A pumping device according to claim 1, wherein said pump is a progressing cavity pump.

5. A pumping device according to claim 1, wherein said solar power converter is a solar cell array.

6. A pumping device according to claim 1, wherein said pump is driven by a electric motor powered by said solar powered converter.

7. A pumping device according to claim 1, wherein said actuator is connected to said solar power converter so as to receive power from said solar power converter.

8. A pumping device according to claim 7 further comprising a battery connected to said solar power converter, wherein said actuator receives power from said battery overnight.

* * * * *